US009391388B1

(12) United States Patent
King, Jr. et al.

(10) Patent No.: US 9,391,388 B1
(45) Date of Patent: Jul. 12, 2016

(54) TWO SEALANT TWO PHASE WIRE CONNECTOR

(71) Applicants: L. Herbert King, Jr., Jupiter, FL (US); Paul James, Omaha, NE (US)

(72) Inventors: L. Herbert King, Jr., Jupiter, FL (US); Paul James, Omaha, NE (US)

(73) Assignee: THE PATENT STORE LLC, O'Fallon, MO (US)

( * ) Notice: Subject to any disclaimer, the term of this patent is extended or adjusted under 35 U.S.C. 154(b) by 53 days.

(21) Appl. No.: 13/999,199

(22) Filed: Jan. 27, 2014

(51) Int. Cl.
*H01R 4/00* (2006.01)
*H01R 13/52* (2006.01)
*H01R 43/20* (2006.01)
*H01R 4/22* (2006.01)

(52) U.S. Cl.
CPC ..... *H01R 13/52* (2013.01); *H01R 43/20* (2013.01)

(58) Field of Classification Search
USPC ..... 174/84 R
See application file for complete search history.

(56) References Cited

U.S. PATENT DOCUMENTS 4,839,473 A * 6/1989 Fox ..... H02G 15/18 174/138 F
5,023,402 A * 6/1991 King, Jr. ..... H01R 4/22 174/87
5,038,003 A * 8/1991 Allec ..... H01R 13/52 174/138 F
5,107,077 A * 4/1992 Fox ..... H02G 15/18 174/138 F
5,113,037 A 5/1992 King et al. ..... 174/87
5,151,239 A 9/1992 King ..... 264/272.11
5,252,779 A * 10/1993 DiRienzo ..... H01R 4/70 174/74 R
6,051,791 A * 4/2000 King ..... H01R 4/12 174/87
6,815,616 B1 * 11/2004 King, Jr. ..... H01R 4/22 174/87
6,958,499 B2 * 10/2005 Hwang ..... B82Y 10/00 257/202
7,122,742 B2 10/2006 King, Jr. et al. ..... 174/87
7,170,005 B1 * 1/2007 King, Jr. ..... H01R 4/22 174/84 R
7,368,663 B1 * 5/2008 Fisher ..... H02G 15/04 174/74 R
8,431,824 B1 * 4/2013 King, Jr. ..... H01R 4/22 174/84 R
2004/0104039 A1 * 6/2004 King, Jr. ..... H01R 4/12 174/87

* cited by examiner

*Primary Examiner* — Timothy Thompson
*Assistant Examiner* — Michael F McAllister
(74) *Attorney, Agent, or Firm* — Jacobson & Johnson LLC

(57) ABSTRACT

A two sealant two-phase wire connector having sequential sealant interfaces for preventing an electrical failure through interactive sealant sharing between a twist-on electrical wire connector having a spiral cavity containing a first waterproof sealant which is immersed in a tube that contains a second water proof sealant, wherein the first water proof sealant and the second water proof sealant each form an interface that shields an electrical connection from the environment.

8 Claims, 2 Drawing Sheets

60
10d
17
18
51
41
40
43
42
45a
10a
16
14
15
44
10
10b
10c

TWO SEALANT TWO PHASE WIRE CONNECTOR

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of twist-on electrical wire connectors in areas that may be wet or exposed to moisture requires the bared ends of the electrical wires, which are mechanically joined through a twisting action, to be protected from exposure to moisture, not only immediately after formation of the electrical connection but in some cases for years or decades after formation of the electrical connection. Compounding the problem of waterproofing an electrical wire connection and in particularly a twist-on wire connector where the electrical wire connection may have to last for decades are the conditions existing during the formation of the electrical connection. Typically, an electrical wire connection is formed on-the-go and in the field where the field conditions and the environment may be adverse to formation of an electrical wire connection and the skills of the electricians forming the electrical wire connections may range from novice to expert.

In one type of waterproofing an electrical wire connection an electrician forms an electrical connection in a sealant filled twist-on wire connector by twisting the wires in relation to the housing of the twist-on wire connector. In the sealant filled wire connectors a sealant, which is located in a central cavity of the twist-on wire connector, provides a waterproof covering over the electrical junction between a set of bared wire ends. Examples of sealant filled electrical twist-on wire connectors are shown in U.S. Pat. Nos. 5,113,037; 5,023,402 and 5,151,239. In these type of sealant filled twist-on wire connectors the wires are inserted through a pierceable cover and into a viscous sealant contained in a wire cavity of the twist-on wire connector. The housing is then twisted with respect to the wires to bring the bared ends of the wires into electrical contact with each other in the presence of the sealant, which forms a sealant air interface to shield the electrical connection from the environment. In some embodiments sleeves are placed on the twist-on wire connector to contain extra sealant. In other embodiment the twist-on wire connector includes clips for looping the wires thereon to prevent the wires from pulling out of the twist-on wire connector.

Another example of a sealant filled wire connector is shown in King U.S. Pat. No. 8,431,824. King U.S. Pat. No. 8,431,824 discloses a direct bury splice kit having a sealant filled twist-on wire connector formed as an integral part of an elongated tube, which contains a sealant. In this example the formation of a sealant covered wire connection occurs within the tube and in one continuous action.

In the above examples the formation of an electrical junction in a sealant filled twist-on wire connector the water resistant wire connection is made in the field and on-the-go by inserting a plurality of bared ends of electrical wires into the waterproof sealant and twisting the wires with respect to the housing of the twist-on wire connector to form a sealant covering around the plurality of bare ends of electrical wires, which are in electrical contact with each other, and a spiral housing located within the twist-on wire connector. This type of sealant filled twist-on wire connector is popular since the formation of the electrical wire connection and the formation of the sealant covering over the bared ends of the electrical wires can be quickly formed without the aid of special tools.

In an immersion method of waterproofing the electrical connection is formed in an electrical wire connector, which contains no sealant. Once the electrical connection is formed the entire wire connector with the electrically connected wire ends therein is immersed in a waterproof sealant. An example of an immersion type of waterproofing an electrical wire connection using a twist-on wire connector can be found in the commercially available direct bury splice kit sold by the 3M electrical products of Austin Tex. and Fox U.S. Pat. No. 4,839,473. Typically, the kit includes, a twist-on wire connector, an elongated tube with an integral cover that is closeable on the wires to provide stain relief and a waterproof sealant, which is located in one end of the elongated tube. The twist-on wire connector and the tube are both stored loosely in a plastic package that is breached before the twist-on wire connector and the elongated tube can be used. The elongated tube contains a sealant in a closed end of the tube and a cover proximate an open end of the tube. The cover can be closed which typically clamps the wires extending into the tube to support the wires with respect to the elongated tube and thus reduce stress on the electrical connection in the twist-on wire connector. In this type of electrical connection formation the twist-on wire connector contains no sealant but once the electrical connection is formed in the twist-on wire connector the entire twist-on wire connector with the electrical connection therein is immersed in the sealant. This type of waterproofing is referred to as an immersion type since the entire twist-on wire connector is immersed in the sealant to form a sealant air interface to shield the wire connector as well as the electrical connection from the environment.

The immersion method of waterproofing twist-on wire connectors, which is shown in U.S. Pat. No. 8,431,824, discloses a direct bury splice kit including an elongated housing having a chamber for inserting a wire connector therein and a lateral wire cradle together with a cover having at least one jaw to clamp a portion of a wire against the wire cradle. Clamping the wire to the container inhibits or prevents loosing of the electrical wire connection while maintaining the electrical wire connection between the ends of wires in a waterproof condition in the sealant of the elongated housing. This type of waterproofing a twist-on electrical wire connector relies on immersion of the twist-on wire connector with the formed electrical junction therein into a body of sealant within a tube or the like.

In contrast U.S. Pat. No. 7,170,005 shows an example of another the twist-on wire connector containing a sealant where the twist-on wire connector is an integral part of a one-piece tube, which eliminates the handling of a separate wire connector. The tube also includes a dome for extending into the tube to force the wires against the tube sidewalls. In this example the formation of the wire connection occurs in the presence of the sealant within the twist-on wire connector, which is a part of a tubular housing.

The above described methods of forming a water resistant electrical connection utilizing twist-on wire connectors fall into two main methods of waterproofing i.e. either waterproofing while forming an electrical connection in a sealant filled twist-on wire connector or waterproofing after forming an electrical connection by immersing the entire wire connector in a sealant. Either method of waterproofing the electrical junction has been found to work well, however, failures have been known to occur with either method of waterproofing.

While such failures are rare the time to failure varies since the failure of electrical connections have been known to occur many months or even decades after the formation of the electrical connection. While it difficult to determine the actual cause of the electrical failure there has been speculation that the failure of the electrical connection, which in some cases is due to exposure of a portion of the bared end of the electrical wires, may be due to human error in forming the electrical connection or human error in the immersion of the twist on wire connector in a body of sealant. While the failure of twist-on wire connectors occurs in both the sealant filled wire connector and the sealant immersed wire connector the time of failure and location of the failure makes is difficult to diagnose the events that lead to the failure of the electrical connection.

Consequently, conditions exist where waterproof twist-on wire connectors, which have a viscous sealant for encapsulating the bared ends of an electrical wire, fail causing a short. Likewise there exist conditions where the twist-on wire connectors, which are immersed in a sealant, also fail. In either case the failures are extremely rare, however, the shear number of twist-on electrical wire connectors used at a work site and through the electrical industry increases the odds that an electrical connection may fail at a job site with the potential for disastrous results.

SUMMARY OF THE INVENTION

A two sealant two-phase wire connector having sequential sealant interfaces for preventing an electrical failure through interactive sealant sharing. The two-phase wire connector comprising a sealant containing tube and a twist-on electrical wire connector having a spiral cavity containing a first waterproof sealant. In the first phase the bared ends of the electrical wires are joined in a twist-on wire connector containing the sealant to form a first sealant/air interface protecting the joined bared ends from contact with the environment. In the second phase the twist-on electrical wire connector and the electrically joined wires are subsequently immersed in a tube, which contains a second water proof sealant, wherein the first water proof sealant and the second water proof sealant sharingly interface with each other to convert the first sealant/air interface to a sealant/sealant interface while the second waterproof sealant forms a sequential second sealant/air interface external to the sealant/sealant interface so that the sealant/sealant interface coaction and the sequential second sealant/air interface form a barrier to the environment to thereby inhibit or prevent a future electrical failure.

DESCRIPTION OF THE PREFERRED EMBODIMENT

Figure 1:
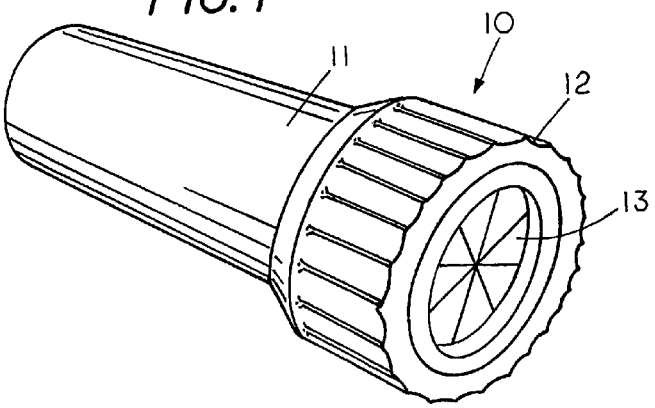
FIG. 1 is a perspective view of a twist-on wire connector containing a water-resistant sealant.

FIG. 1 is a perspective view of a twist-on wire connector 10 containing a water-resistant sealant with twist-on wire connector 10 having an outer electrically insulating shell 11 and a base 12 with a peripheral band of ridges 10*a* for grasping between the user's thumb and fingers. A pierceable cover 13 comprising a set of pie shaped flexible segments 13*a* extends over the open end of the connector 10. The flexible segments flex in response to axial wire pressure to enable a person to insert electrical wires into the interior of the twist-on wire connector and into twisted engagement with each other in a chamber in the interior of the twist-on wire connector 10.

Figure 2:
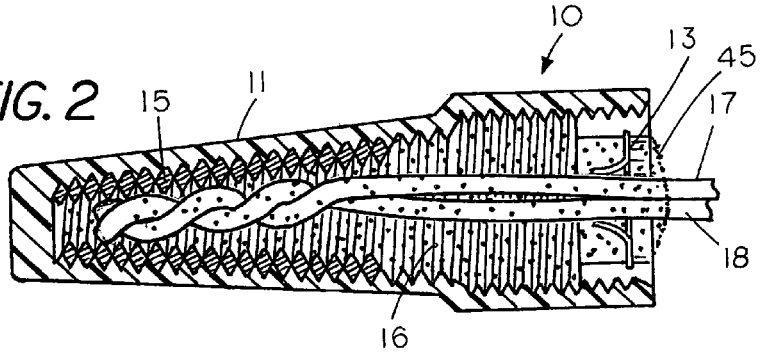
FIG. 2 is a cross sectional view of the twist-on wire connector of FIG. 1 with the sealant in the twist-on wire connector extending past the junction of the electrical wires.

FIG. 2 shows a sectional view of the twist-on wire connector 10 of FIG. 1 revealing an interior spiral coil 15 and a sealant 16 located in a chamber 14 within the twist-on wire connector 10. A pair of electrical wires 17 and 18 having bared ends 17*a* and 18*a* are shown electrical joined to each other in the presence of the sealant 16 within the twist-on wire connector. In this example the insertion of the electrical wires 17 and 18 into the twist-on wire connector 10 forces sealant 16 outward past the cover 13 of the twist-on wire connector to create a sealant air interface 45 that extends axially outward from the wire or open end 19 of the twist-on wire connector as the wires are twisted into electrical engagement with each other.

In the above example the twist-on wire connector 10 includes a pierceable cover and sufficient sealant that extends outward of the twist-on wire connector when the wires are inserted into the twist-on wire connector 10. However, other twist-on wire connectors may or may not have a pierceable cover. Also in other twist-on wire connectors the sealant contained within the twist-on wire connector may be less so that the sealant is not forced out of the connector when the wires are engaged. In still others the volume of the wires may be insufficient to force the sealant out of the twist-on wire connector. Thus the sealant/air interface 45 may be inside or outside of the twist-on wire connector 10. Typically, the formation of an electrical connection in the presence of a sealant such as shown in FIG. 2 provides a reliable waterproof protection of the electrical connection therein. However, for reasons not fully understood, although rare, a failure of the electrical connection may occur sometimes years or decades after the electrical connection has been formed within the twist-on wire connector. Reasons for the failure of the electrical connection remain unknown although some speculate a factor involved the skill of the person forming the electrical connection.

Figure 3:
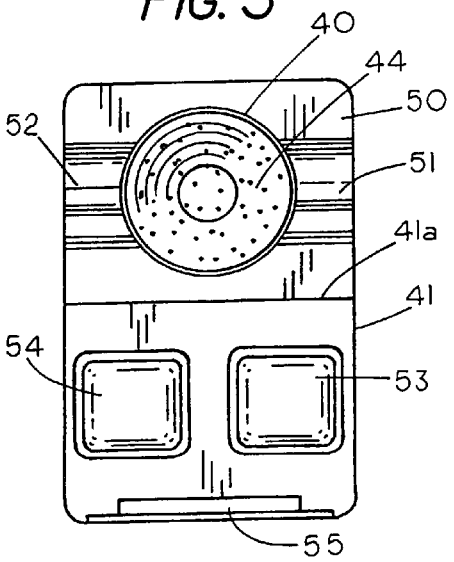
FIG. 3 is a top view of a container and cover for receiving a sealant.
Figure 4:
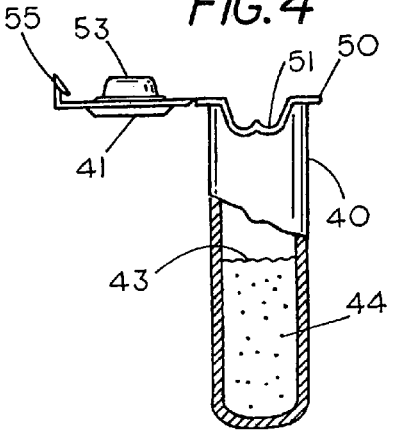
FIG. 4 is a side view partially in section showing the container of FIG. 3 with a sealant therein.

FIG. 3 and FIG. 4 show another device for waterproofing an electrical connection through immersion of an entire electrical wire connector. FIG. 3 is a top view of a container 50 having a wire ledge 51, a wire ledge 52 and a tube 40 for receiving a sealant 44. In this example a cover 41 includes a flexible dome 53 and a flexible dome 54, which can be used to clamp wires to a wire ledge 51 and a wire ledge 52. A living hinge a allows one to close the cover 50 and a latch 55 that engages with extension 50 allows one to secure the cover 41 thereto as the wires are clamped to the container.

FIG. 4 is a side view of the container 40, which comprises an elongated tube with the tube 40 partially in section, showing a viscous sealant 44 located therein. This type of container is often used instead of sealant filled twist on wire connectors or in other cases when electrically joined wires without a connector are immersed directly into the sealant in order to protect the wire junction therein from failure. The device of FIG. 4 provides a reliable waterproof protection of the electrical connection therein through immersion of the wire connector. However, for reasons not fully understood, although rare, a failure of immersed electrical connectors may occur, sometimes years or decades after the electrical connector has been immersed in the container 40. Reasons for the failure of the electrical connection although infrequent remain unknown.

Thus, there exist two separate systems for waterproofing an electrical connection and both have the same problem, namely, that failure of the electrical connection may occur years or decades after the formation of the electrical connection with the reason for the failure not fully understood. In the present invention two electrical wire waterproofing systems, which have the same type of failure, are utilized in part to provide a two sealant two phase electrically safety connector that virtually eliminates failures that occur when each of prior art waterproofing systems are used alone.

Figure 5:
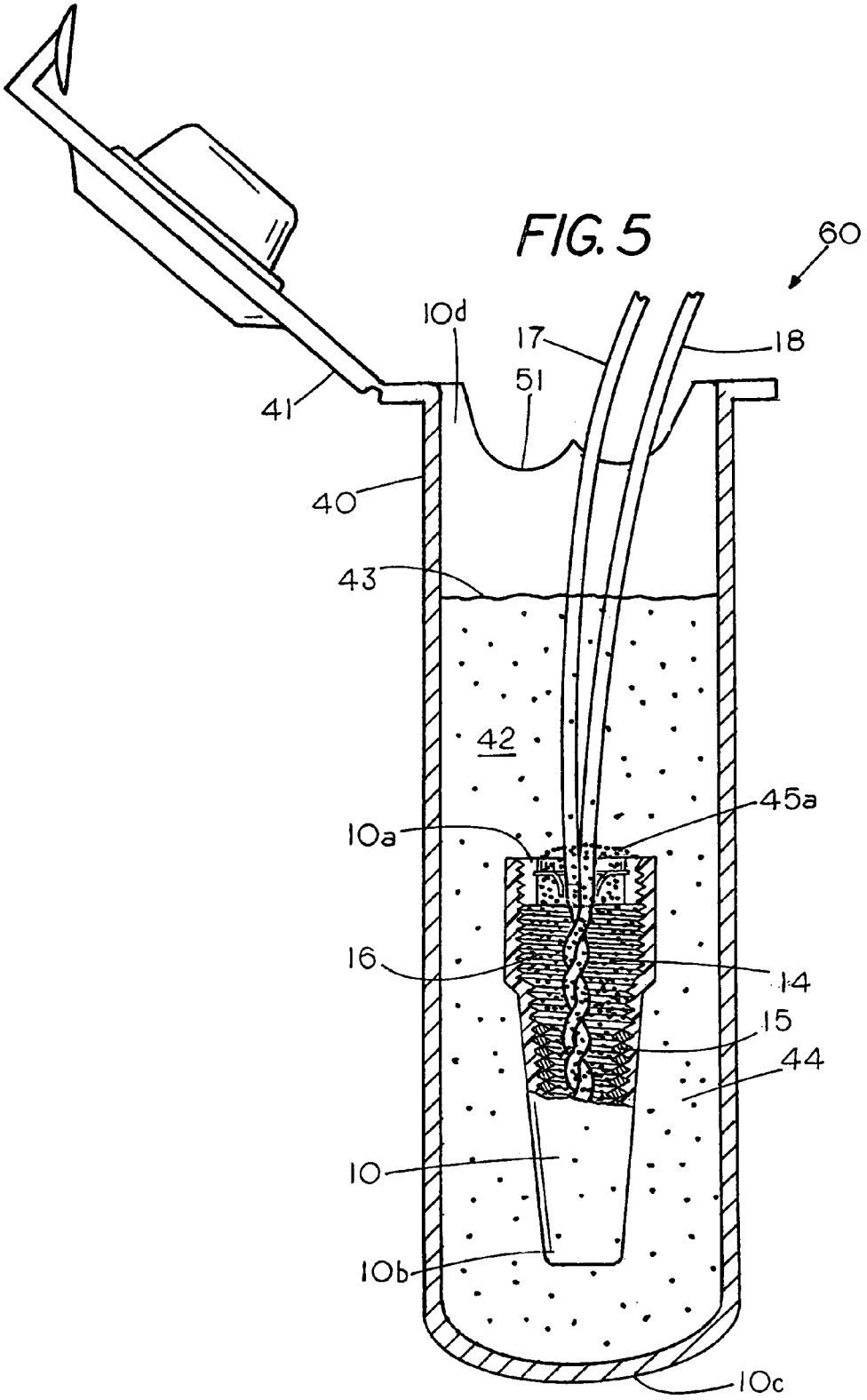
FIG. 5 is a sectional view of the twist-on wire connector and wires of FIG. 2 immersed in the sealant in the container.

FIG. 5 shows a partial view of a two-sealant two-phase safety connector 60 that provides enhanced resistance to failure of an electrical junction, which can occur in either sealant filled twist on wire connectors or sealant immersed twist-on wire connectors, which contain no sealant within the twist-on wire connector. In the example of FIG. 5 the sealant containing twist-on wire connector 10 of FIG. 2, which has a sealant air interface 45, has been immersed in a body of sealant 44 in container or elongated tube 40. The immersion of the twist-on wire connector 10 of FIG. 2 into the sealant 44 of container 40 converts the sealant/air interface 45 into a sealant/sealant interface 45*a*, which is located below a sealant/air interface 43. Thus, in the first phase the wire connection within twist-on wire connector 10 is located beneath a sealant air interface 45 and in the second phase the wire connection is located beneath a sealant/sealant interface 45*a* and a sealant/air interface 43.

FIG. 5 shows the two-sealant two-phase electrical safety connector 60 for prevention of an electrical failure comprising a twist-on wire connector 10 having a wire end 10*a*, a closed end 10*b* and a spiral coil 15 for electrically engaging a plurality of wires therein. A first viscous waterproof sealant 14 is located in a chamber 44 in the twist-on wire connector with a plurality of electrically joined electrical wires 17 and 18 within the chamber 14 of the twist-on wire connector with the electrically joined wires 17 and 18 located proximate the first viscous waterproof sealant 14 in the twist on wire connector 10. The safety connector 60 includes an elongated tube 40 having an interior space therein with sufficient width to freely receive the twist-on wire connector 10 with the elongated tube having a closed end 10*c* and an open end or wire end 10*d*. A second viscous waterproof sealant 44 is located in a closed end of the tube with the second viscous waterproof 44 having a sealant/air interface 43. As shown in FIG. 5 the twist-on wire connector 10 with the plurality of electrically joined wires 17 and 18 proximate the first viscous sealant are immersed below the sealant air interface 43 to form a sealant/sealant interface 45*a* below the sealant air interface 43. In this state the sealant 44 and sealant 16 being proximate to each other form a sealant sharing relationship.

In the example shown in FIG. 5 the first viscous sealant and the second viscous sealant are the same, however, in some cases one may have the second sealant different from the first sealant. The viscous sealants are sufficient flowable so as to flow around the wires and the twist-on wire connector as the electrical wire connector is inserted into the sealant.

As viewed in FIG. 5 a portion of the electrical wires 17 and 18 extending from the twist-on wire connector 10 are covered by the first viscous sealant 14 and a further portion are covered by the second viscous sealant 44 with the interface 45*a* separating the two portions of the electrical wires. FIG. 2 shows the two-sealant two-phase electrical safety connector 60 wherein the sealant/air interface 43 is larger than the sealant/sealant interface 45*a* and the sealant/air interface is located below a cover 41 of the elongated tube when the cover is in a closed condition.

A feature of the invention shown herein is that it may be sold as a kit for protecting a junction in a twist-on wire connector from an electrical failure with the kit comprising: a twist-on wire connector 10 having a first viscous sealant 16 therein with an air sealant interface 45 and a container 40 having a second viscous sealant 44 therein wherein the sealant 44 in the container has a second air sealant interface 43 and the container is larger than the twist-on wire connector 10 and the amount of the second viscous sealant 44 is sufficient to enable immersion of the twist-on wire connector 10 below an air sealant interface 43 of the second viscous sealant 44. In this example the container comprises an elongated tube 40 with a cover 41 for securing a plurality of wires to the container with the area of the sealant/air interface 43 of the second sealant 44 larger than the area of the sealant/air interface 45 of the twist-on wire connector 10.

In some kits the first viscous sealant and the second viscous sealant may be the same and in other cases one may prefer to use different sealants. A feature of the invention is that the sealant/air interface of the elongated tube is larger in area than the area of the sealant/air interface of the twist-on wire connector and the size of the twist-on wire connector is sufficiently small such that it is immerseable and spaceable from a sidewall of the container as illustrated in FIG. 5 to maintain a body of sealant around the entire twist-on wire connector.

We claim:

1. A two-sealant two-phase electrical safety connector for prevention of an electrical failure:

a twist-on wire connector having a wire end, a closed end and a spiral coil for electrically engaging a plurality of wires therein;

a first viscous waterproof sealant located in a chamber in the twist-on wire connector with said first viscous waterproof sealant having a sealant/air interface;

a plurality of electrically joined electrical wires within the chamber of the twist-on wire connector with the electrically joined wires located proximate the first viscous waterproof sealant in the twist on wire connector and behind the sealant/air interface;

an elongated tube having an interior space therein with sufficient width to receive the twist-on wire connector, said elongated tube having a closed end and an open end;

a second viscous waterproof sealant located in a closed end of the tube with said second viscous waterproof sealant interfacing with the sealant air interface of the twist-on wire connector when the twist-on wire connector is immersed in the second viscous waterproof sealant to thereby form the sealant/air interface of the twist-on wire connector into a sealant/sealant interface.

2. The two-sealant two-phase electrical safety connector of claim 1 wherein the sealant/sealant interface is located external to the twist-on wire connector.

3. The two-sealant two-phase electrical safety connector of claim 1 wherein the elongated tube includes a cover.

4. The two-sealant two-phase electrical safety connector of claim 3 wherein the twist-on wire connector is supported in the second viscous waterproof sealant in the tube by engagement of the electrical wires between the cover and the tube.

5. The two-sealant two-phase electrical safety connector of claim 1 wherein the first sealant and the second sealant are the same.

6. The two-sealant two-phase electrical safety connector of claim 1 wherein a portion of the electrical wires extended from the twist-on wire connector are covered by the first viscous sealant and a further portion are covered by the second viscous sealant.

7. The two-sealant two-phase electrical safety connector of claim 1 including a cover on the twist-on wire connector.

8. The two-sealant two-phase electrical safety connector of claim 1 wherein the second viscous waterproof sealant has a sealant/air interface area that is larger than a sealant/sealant interface area.

* * * * *